US007819149B2

(12) United States Patent
Lucander et al.

(10) Patent No.: US 7,819,149 B2
(45) Date of Patent: Oct. 26, 2010

(54) METHOD AND APPARATUS FOR MECHANICAL DEFIBRATION OF WOOD

(75) Inventors: Mikael Lucander, Esbo (FI); Tomas Björkovist, Tampere (FI); Olli Tuovinen, Tampere (FI)

(73) Assignees: Metso Paper, Inc., Helsinki (FI); M-real Oyj, Espoo (FI); Myllykoski Oyj, Helsinki (FI); Stora Enso Oyj, Helsinki (FI); UPM Kymmene Oyj, Helsinki (FI)

( * ) Notice: Subject to any disclaimer, the term of this patent is extended or adjusted under 35 U.S.C. 154(b) by 1090 days.

(21) Appl. No.: 11/446,501

(22) Filed: Jun. 5, 2006

(65) Prior Publication Data

US 2006/0283990 A1 Dec. 21, 2006

(51) Int. Cl.
*B27M 1/00* (2006.01)

(52) U.S. Cl. ..... 144/359

(58) Field of Classification Search ..... 144/361, 144/162.1, 359; 241/293, 300; 451/56, 527, 451/443

See application file for complete search history.

(56) References Cited

U.S. PATENT DOCUMENTS

| | | | | |
|---|---|---|---|---|
| 2,277,520 | A * | 3/1942 | Martin et al. | 51/293 |
| 3,132,815 | A * | 5/1964 | Wagner | 241/282.1 |
| 3,153,511 | A | 10/1964 | Atack et al. | |
| 5,707,409 | A * | 1/1998 | Martin et al. | 51/295 |
| 5,921,856 | A * | 7/1999 | Zimmer | 451/539 |
| 6,054,183 | A * | 4/2000 | Zimmer et al. | 427/249.8 |
| 6,241,169 | B1 | 6/2001 | Björkqvist | 241/24.29 |
| 2005/0276979 | A1 * | 12/2005 | Slutz et al. | 428/408 |

FOREIGN PATENT DOCUMENTS

WO 91/09707 A 7/1991

OTHER PUBLICATIONS

Atack, D. et al., "Mechanical Pulping Studies With a Model Steel Wheel ", *Pulp and Paper Magazine of Canada*, 63 (1962): 1, pp. T10-T20.

Atack, D., "Mechanical Pulping at the Institute, Part III: Mechanics of Wood Grinding", *The Activities of the Pulp and Paper Research Institute of Canada, Trend Report*, 19 (1971), pp. 6-11.

Klemm, Karl H., "The Interpretation of Groundwood Production by Fibre Technology", *Pulp and Paper Magazine of Canada*, 56 (1955): pp. 178-205.

Steenberg, Börje et al., "Production and Dissipation of Frictional Heat in the Mechanical Wood Grinding Process", *Tappi*, vol. 45(1962):4, pp. 333-336.

(Continued)

*Primary Examiner*—Shelley Self
(74) *Attorney, Agent, or Firm*—Kubovcik & Kubovcik

(57) ABSTRACT

The present invention provides a novel method and apparatus for producing pulp from lignocellulosic raw material, such as wood or annual or perennial plants, by mechanical defibration. According to the invention, fibers are peeled from the wood by means of grinding grits arranged on a defibration surface, wherein at least 90% of the protrusion difference distribution between adjacent or neighboring grits on the surface belongs to a value region maximally as wide as the average grit diameter. By means of the invention, a reduction in specific energy consumption of up to 50% or even more can be obtained.

9 Claims, 7 Drawing Sheets

OTHER PUBLICATIONS

Björkqvist, Tomas et al., "Grinding Surface with an Energy-Efficient Profile", *International Mechanical Pulping Conference*, Helsinki, Finland, Jun. 4-8, 2001, Proceedings vol. 2, pp. 373-380.
Bergström, J. et al., "Analysis of Grinding Process Variables", *Svensk Papperstidning* 60(11) (1957): pp. 409-411.
Sandås, Eva, "Effects of Pulpstone Grits in Wood Grinding, Part 3. Two-Size Grit Mixture (Various Sizes)", *Paperi ja Puu—Paper and Timber* 73(1991):7, pp. 641-650.
Lucander, Mikael et al. "New Approach on the Fundamental Defibration Mechanisms in Wood Grinding", *IMPC 2005*, International Mechanical Pulping Conference, Oslo, Norway, Jun. 7-9, 2005, Proceedings, pp. 149-155.
Paulapuro, Hannu, "Operating Model of a Grinder, Part I. Interdependence of Motor Load and Rate of Production of a Grinder," *Paperi ja Puu* 58 (1976) 1, pp. 5-18.
Paulapuro, Hannu, "Operating Model of a Grinder, Part II. Interdependence of Grinding Process Variables and Groundwood Pulp Quality Parameters," *Paperi ja Puu* 58 (1976) 10, pp. 659-678.
Miles, K.B. et al. "The Flow of Pulp in Chip Refiners", *Journal of Pulp and Paper Science*, 16(2): (1990), pp. J63-J72.

* cited by examiner

METHOD AND APPARATUS FOR MECHANICAL DEFIBRATION OF WOOD

BACKGROUND OF THE INVENTION

1. Field of the Invention

The present invention relates to the production of mechanical and chemimechanical pulp. In particular, the present invention provides a novel method and apparatus for producing pulp from lignocellulosic raw material, such as wood or annual or perennial plants, by mechanical defibration.

2. Description of Related Art

The need to develop mechanical pulping processes is more eminent than ever. The fact of rising electricity prices, which continuously reduce the competitiveness of the processes, is now imminent. Also, the demand for more pulp for even more productive paper machines calls for higher pulp production on existing lines, and this may particularly concern groundwood pulping, because new production lines can be uneconomical to fit into existing facilities.

The grinding of fresh wood is a mature process for the production of pulp for the papermaking process. During the long period of its industrial use the process has many times been the subject of research. The fundamental defibration mechanisms of grinding are complex and difficult to observe, making the process a challenge for researchers for decades. One of the most active periods started in the 1950s when researchers worked with pulp characterization and started to describe the fundamental mechanisms behind defibration. By the early 1990s, however, the situation had stagnated to the point where the well-known operating curves were broadly accepted as physical relations that could not be changed.

There is a need for an improvement of today's wood grinding process.

Various defibration mechanisms have been proposed by Atack and co-workers (1, 2) as well as by Klemm (3), Steenberg and Nordstrand (4).

SUMMARY OF THE INVENTION

The present invention is based on the idea that whereas in conventional grinding, loosening of the wood fiber structure and fiber removal phases both are achieved with the same grit structure on the grinding surface, in the present invention an unconventional base form on the grinding surface is used for fiber loosening while the grit surface removes the fibers. This became possible when it was discovered that a more efficient loosening (i.e. fatigue) process could be achieved with a surface wave form of much larger size than that used in fiber removal (i.e. peeling) (5).

Thus, the invention provides for separation of the fatigue (kneading) and the separation (peeling) phases in a grinding type mechanical defibration process. A defibration surface (grinding surface) with a base wave pattern having a specific amplitude and specific wave length can be used for mainly performing the fatigue phase. By contrast, the fiber separation phase is carried out with synthetic or semisynthetic grits of a preselected dimension and form. The grits are attached onto the base surface in a two dimensional layer in order to achieve perpendicular protrusions of the grits at approximately the same distance from the base level. The grinding process is in this invention performed, preferably, at low peripheral speeds but at high production levels.

According to the invention, a method of mechanical defibration of wood therefore comprises the steps of peeling fibers from the wood by means of grinding grits arranged on a defibration surface, wherein at least 90% of the protrusion difference distribution between adjacent or neighboring (which are used synonymously) grits on the surface belongs to a value region maximally as wide as the average grit diameter. In other words, the grits have a small variation in grain size (typically the deviation of the grain size is less than 30%, in particular less than 20%, of the mean or average diameter) and they are attached to the surface in such a way that at least 90% are located at a distance of less than the average grit diameter from the surface of the outermost grits.

An apparatus for mechanical defibration of wood by fiber peeling from the wood using grinding means comprises means having a defibration surface with grinding grits, wherein at least 90% of the protrusion difference distribution between adjacent grits seen on the surface belongs to a value region maximally as wide as the average grit diameter.

Considerable advantages are obtained by means of the invention. The present invention gives a considerable reduction in specific energy consumption of up to 50% or even more. This radical reduction in energy demand is achieved in grinding by producing a more effective strain pulse during the wood loosening phase and by combining this high-fatigue treatment with appropriate fiber peeling. Experimental data support the novel approach to defibration, the mechanism of which is described in more detail below.

Splitting the grinding surface functions between the different phases of on one hand kneading and, on the other, peeling, in the defibration process will make it possible to avoid the problem of the art involving a compromise in achieving good fiber fatigue and good fiber peeling with the same grit structure on the grinding surface. It should be pointed out that when the term "peeling" in grinding is used for describing the "pulling out of whole fibers from the wood matrix" it has a different meaning than peeling in refining, where it is used to describe the unwrapping of different fiber layers in the processing of the coarser fibers in secondary or reject refining stages.

In grinding, the present invention allows for optimization of the phase involving fatigue of the fiber structure as one process and the fiber peeling phase as another process. Naturally, there is interaction between the two phases, as will be discussed below.

Next the invention will be described more closely with the aid of a detailed description and working examples.

BRIEF DESCRIPTION OF THE DRAWINGS

In the attached drawings,

In FIGS. 4 to 15, the following legends are used:

open symbols shower water temp/casing pressure=95° C./250 kPa, closed symbols=120° C./450 kPa Ref=reference stone and W=wave surface.

Symbols labeled further with 10 represent pulps ground at 10 m/s peripheral speed of grinding surface. Other labels represent pulps ground at 20 m/s peripheral speed of grinding surface.

DESCRIPTION OF PREFERRED EMBODIMENTS

In connection with the present invention, the fiber peeling phase has been studied in detail. The use of a certain base form on the grinding surface to provide fatigue is discussed in an earlier paper (5). The main conclusion in that paper is that the loosening phase of the grinding process can be controlled and made more energy efficient by introducing the waveform on the grinding surface. The main design parameters of the surface form are modulation amplitude and frequency.

As mentioned above, an objective of the present invention is to radically reduce the energy demand in the grinding process by producing a more effective strain pulse in the wood loosening phase and by combining this high fatigue treatment with appropriate fiber peeling.

First, the technical background of the invention will be examined in detail below with reference to the discussion in an earlier paper (9). Then, some experimental result will be given.

To get a clearer basis for discussing the fiber peeling phase it is convenient to define an expression that describes the vital conditions of fiber peeling. Most crucial in this respect is the nature of the preservation of the fiber structure, i.e. to elucidate whether fiber peeling preserves fiber length or causes undesirable fiber cutting. The expression "fiber peeling harshness" has been chosen to reflect how roughly the fiber material is removed from the fatigued wood surface.

In grinding, the wood structure state and the removal action determine the nature of fiber peeling. It should be pointed out here that fiber peeling harshness is then a function of the parameters related to the wood itself, the defibration surface and the control of defibration. The use of this term is to some extent comparable to the use of the term 'refining intensity' in thermomechanical pulping discussions (6).

Figure 1:
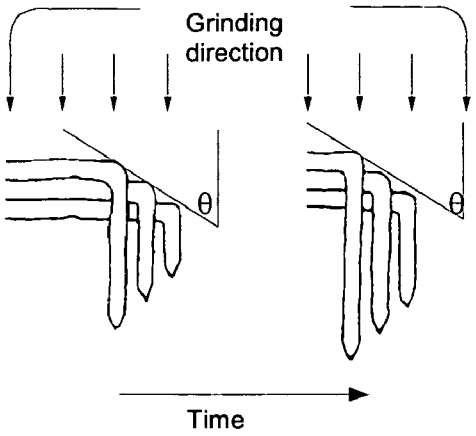
FIG. 1 depicts fiber peeling schematically, redrawn from reference 2.

Fiber peeling harshness is directly connected to the action of fiber peeling forces on one part of the newly exposed fiber, FIG. 1. As long as the fiber remains partly bound to the wood matrix, friction forces due to fiber peeling and counter forces due to bonding to the matrix stress the fiber. At this moment, these two forces and the fiber strength at the weakest position determine the outcome of the action. The strength of the fiber should preferably exceed the counter forces throughout fiber peeling, while the diminishing bonding force should gradually fall below the fiber peeling force at the end of fiber peeling. The envisaged outcome would enable the production of long slender fibers with good bonding abilities. What normally happens in grinding, however, is that the fiber is unable to withstand the counter force and the fiber cuts. When the grinding process starts to cut too much, the critical fiber peeling harshness is exceeded.

The most discussed parameters affecting fiber peeling harshness are those related to defibration control, which have been used for decades in controlling the quality of groundwood pulp (7, 10, 11). Defibration surface velocity is an explicit parameter in the classic grinding model, while wood feeding rate and force are only implicitly present through grinding power. Showering water temperature is commonly used, at least partly, to control the grinding zone temperature.

An increase of defibration surface velocity gives an increase in fiber peeling harshness as a direct implication of higher fiber peeling forces. One reason is the second law of motion, which means higher forces for higher surface fiber acceleration; the main reason, however, is the higher force needed to deform the surface fiber layers at higher velocity due to the viscoelastic nature of wood.

In addition to this, it is most likely that this higher impact locally will also damage the fiber, which then implies lower fiber strength at the weakest position of the fiber.

Increasing the wood feed rate results in a greater feeding force, which means greater penetration of the active part of the defibration surface. Greater penetration, in turn, implies higher fiber peeling forces, and therefore an increase in both wood feeding rate and force also give an increase in fiber peeling harshness.

An increase in grinding zone temperature on the other hand decreases the fiber peeling harshness implying a decrease in fiber cutting probability. One reason is that a high temperature in the surface fiber layers gives low viscoelastic values, which implies lower deformation forces Another important reason is that the forces bonding fibers to the matrix are also low at high temperatures.

Parameters affecting fiber peeling harshness and related to wood structure state at defibration conditions are the viscoelastic properties of wood, the forces bonding fibers to the matrix, and the strength of the fibers themselves. Different wood species and also different wood from the same species have different stiffness, i.e. viscoelastic properties, different forces bonding fibers to the matrix, and different fiber strengths. High viscoelastic values give high deformation forces, which means that an increase in wood species stiffness involves an increase in fiber peeling harshness. By definition, a growth in the forces bonding fibers to the matrix also gives an increase in the fiber peeling harshness. An increase in the fiber strength, on the other hand, lowers the fiber peeling harshness, also by definition. Wood density correlates fairly well with stiffness and can thus be used as an easily measurable parameter representing original wood. High moisture content by itself implies low stiffness and also helps to lower stiffness at elevated temperature. By applying the above reasoning with change in stiffness we can state that a raise in moisture content reduce the fiber peeling harshness.

The cumulative fatigue treatment and temperature of the wood encountering the fiber peeling phase greatly influence or even dominate fiber peeling harshness. Even if the fiber and its characteristics are finally formed during the fiber peeling phase, the importance of controlling the loosening phase, where the temperature and fatigue treatment are determined, is clearly revealed here. Fatigue treatment lowers the viscoelastic properties and the forces bonding fibers to the wood matrix. Fatigue treatment also loosens the fiber cell wall internally, which increases the flexibility of the fiber e.g. its ability to withstand cutting, especially in those stress situations where bending is present. A decrease in viscoelasticity results in lower fiber peeling forces. This and the lower fiber bonding forces and the higher fiber strength all by definition lower the fiber peeling harshness. We can then state that an increase in cumulative fatigue treatment has a strong decreasing impact on the fiber peeling harshness.

A rise in temperature, due to dissipation of mechanical energy in the loosening phase, has much the same effect as fatigue treatment. Viscoelastic properties and fiber bonding forces decrease, even the internal structure of the fiber wall softens and the fiber becomes more flexible. A strong decreasing influence on the fiber peeling harshness, now as a result of raised wood temperature, is achieved.

A third group of parameters affecting fiber peeling harshness is related to the defibration surface. Different grit sizes are commonly used to produce pulp for manufacturing different grades of paper. These pulps can be recognized by among others their different freeness ranges. Grit size also affects fiber peeling harshness. This is due to the fact that the part of the grit penetrating into the wood has a less steep rising form in the case of a larger grit than a smaller grit at the same feeding pressure (8). The penetration becomes smaller and the direction of the deformation force becomes more perpendicular to the surface velocity; both reduce the fiber peeling force, which is a force in the surface velocity direction. Additionally, the local pressure under the active areas decreases, implying less local damage to the fibers. Both the lower fiber peeling force and the higher fiber strength means that an increase in grit size implies a decrease in fiber peeling harshness.

The second parameter in this third group is the grit form. In view of the size difference between fiber width and grit diameter, it is conceivable that an active sharp cornered grit means greater local penetration and pressure on the wall of a fiber perpendicular to the grit movement than an active bulky grit. Excessive local pressure easily damages the fiber wall, with lower fiber strength as a direct consequence. This reasoning clearly shows that an increase in grit roundness decreases the fiber peeling harshness. The grits used in the present invention preferably have a shape factor of higher than 0.82.

Conventional grinding-type wood defibration is based on interaction between a ceramic grinding surface and moist wood. Both the fatigue i.e. kneading and fiber separation i.e. fiber peeling phases are performed with the same grits in the grinding material. This conventional solution is possible due to the 3-dimensional bulk formed structure of the grinding material, which generates a broad height distribution of the surface grits. In this context the protrusion of the grits is essential because a broad height distribution, as in the case of the conventional grinding material, also then implies broad distribution in the fiber peeling harshness.

Fiber peeling at high harshness is always more energy effective than that at a low harshness to a given level of pulp freeness but the practice is that the harshness should not exceed the critical fiber peeling harshness limit i.e. the impact on the fiber should not exceed the strength of the fiber. By following this rule the tail of high value of the broad harshness distribution will become restrictive in the fiber peeling. Accordingly the tail of low value of the broad harshness distribution will mean loss of grinding energy without significant peeling actions. Consequently only a small part of the grits in the height distribution of conventional grinding material performs energy effective fiber peeling.

It is possible to use different properties of the defibration surface for the kneading and the fiber peeling as discussed earlier and disclosed in U.S. Pat. No. 6,241,169, the contents of which is herewith incorporated by references. There the kneading is performed with a defibration surface which exhibits, in side view, a base wave form. As a result of this form, the surface at larger size category does not participate in the fiber peeling.

The height (amplitude) of the waves and the distance between them is determined in such a way that it is always possible to select such a surface speed that a suitable cycle length is obtained for the wood to be defibrated The amplitude may be of the order of 0.1 to 10 mm, in particular about 0.2 to 1 mm (e.g. 0.5 mm) and the distance between waves of the order of 1 to 50 mm, but these are only exemplary values.

The wave pattern of the surface can naturally be modified; however, the resulting cycle length should preferably be 1 to 3 times the average relaxation time of the wood raw material, i.e. a half of it corresponds approximately to the average relaxation time. The falling portion of the wave pattern, in particular, must be changed in order to achieve sufficient free space for the loosened fibres. As explained in U.S. Pat. No. 6,241,169, when a defibration surface of the above kind moves at a peripheral speed in relation to wood raw material, such as logs or chips, the wood raw material is subjected to regular treatment, the cycle length (i.e., timelength) of which is determined by the contour of the defibration surface and the peripheral speed. The rising portions of the defibration surface compress the wood raw material, whereas the falling portions allow the wood raw material to expand. If such a combination of peripheral speed and regular shape of the defibration surface is selected that a half of the resulting cycle length corresponds to the average relaxation time of the wood raw material, the following rising portion bits the surface of the wood raw material when the change in the momentum required for maintaining the vibration is small.

In the present invention fiber peeling is performed with the use of a 2-dimensional layer formed grit structure on a surface—for example a surface of the above described type exhibiting a smooth base form. The height distribution above the base form of the grit structure (i.e. distribution in Z-direction) is narrow as a result of the 2-dimensional structure and the bulky one size form of the used grits. Consequently the invention implies a narrow harshness distribution around a desired value for fiber peeling, which enables optimal fiber peeling harshness for all grits giving rise to an energy effective fiber peeling as a whole. This situation can be compared to the corresponding situation of a conventional solution, where only a minor part of the grits performs energy effective fiber peeling and the major part causes more or less useless energy consumption regarding fiber peeling. The grits used in the invention are preferably of a predominantly spherical shape. It is particularly preferred that they are spherical with a deviation of about 30% or less from the absolutely spherical form, although it is preferred that the grit has a surface with a certain degree of irregularity or amount of coarseness allowing for an opening of the fiber surface.

The irregularities on the surfaces of the grits can comprise obtuse-angled corners. As grinding is carried out in the presence of water and irregularities on the grits will assist in providing sufficient contact with the fibres of the wood raw material through the water film to increase the release of fibres and to roughen the surface of them.

As known in the art, the grits are separate particles which are attached on and fixed to a defibration surface typically comprising a metal plate. For mechanically fixing the grits to the surface, various techniques, such as electroplating (i.e. galvanic coating), brazing and laser coating, can be used, as will be discussed below. Generally, the grits are much more durable against wear than the metal material to which they are fixed. They are usually evenly distributed on the surface and spaced apart from each other such that the distances between individual grits (calculated from their outer surfaces) amounts to 0 to 15, preferably 0 to 10 and in particular about 0 to 8 times the average diameter of the grits, the value 0 meaning that two grits are in direct contact with each other. According to a specific embodiment, the distance between individual grits is at the most 5 times, in particular at the most 3 times, the average diameter. A minimum distance of 0.1 to 1 times the diameter can be advantageous in all of the above cases, although the invention is not limited to such an embodiment.

The material of the grit is a suitable hard material of synthetic or semisynthetic origin. As examples of suitable materials, the following can be mentioned: alumina, diamond, tungsten carbide, silicon carbide, silicon nitride, tungsten nitride, boron nitride, boron carbide, chromia, titania, mixture of titania, silica and chromia and mixtures containing two or more of these compounds. Preferred materials are aluminium oxide and aluminium oxide based materials.

The particle size of the grit is generally about 10 to 1000 micrometer, preferably about 50 to 750 micrometer, in particular about 100 to 600 micrometer. Grits of a mesh of about 60 (250 um) have been used in the examples below. Such grits are then arranged in such a way that the distance from the surface on the opposite side of the grinding substrate or plate, to which they are bonded, of at least 90% of the grits to a plane parallel with the tangent of the surface of the outermost grits is at maximum equal to the average particle size of the grits (which is, e.g., 10-1000 micrometers).

A grinding tool where the active grinding forms comprising grinding protuberances which are all on the same height level is disclosed in U.S. Pat. No. 3,153,511. The known grinding protuberances have crowns which are arcuate in the direction of movement. The proturberances are machined in metal or synthetic resin and they will be deformed during operation of the device. Because of the arcuate form and the deformation, the proturberances will not efficiently provide both loosening of the wood structure and detachment of fibres from the wood but rather warm up the wood structure. Therefore, the know solution has not produced a satisfactory grinding tool as evidence by the fact that such metal grinding wheels have not replaced pulp stones in spite of the disadvantage of ceramic pulp stones.

Figure 6:
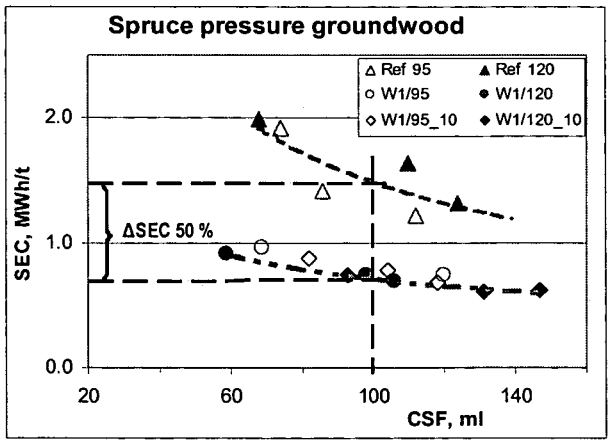
FIG. 6 shows the specific energy consumption vs. pit pulp freeness.
Figure 7:
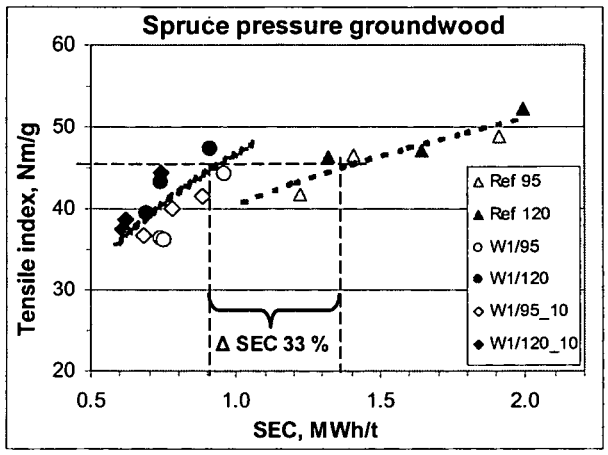
FIG. 7 shows the tensile strength vs. specific energy consumption.

The invention has been tested on laboratory scale equipment and the trials show that the specific energy consumption in grinding with an energy efficient surface is 50% lower at the same freeness and 30% lower at the same tensile strength compared to that of a conventional pulpstone construction, FIG. 6 and FIG. 7.

Based on the above, the present invention comprises a method for mechanical defibration of wood, the method comprising fiber peeling from the wood by means of grinding grits on the defibration surface wherein at least 90% of the protrusion difference distribution between adjacent or neighboring grits on the grinding surface belongs to a value region as wide as the average grit diameter. Preferably at least 92% or even 95% of all grits have a height falling within that range. Thus, on one hand it is preferred to have all or at least practically all (95% or more) grits located on the surface in such a manner that the distance from their surface to the tangent of the surface of the outermost grits is less than the diameter of the grits. On the other hand, it is also preferred that the distance from the surface to the tangential surface is as small as possible. E.g. the distance can be, on an average less than 75%, in particular less than about 50% or even less than about 30%, of the average grit diameter. Ideally, all or almost all grits have an outer surface that lies on the same tangential surface.

As a result, the surface will macroscopically appear rather even and smooth. Importantly, there are no or essentially no protruding individual grits which will cut fibres.

Figure 16:
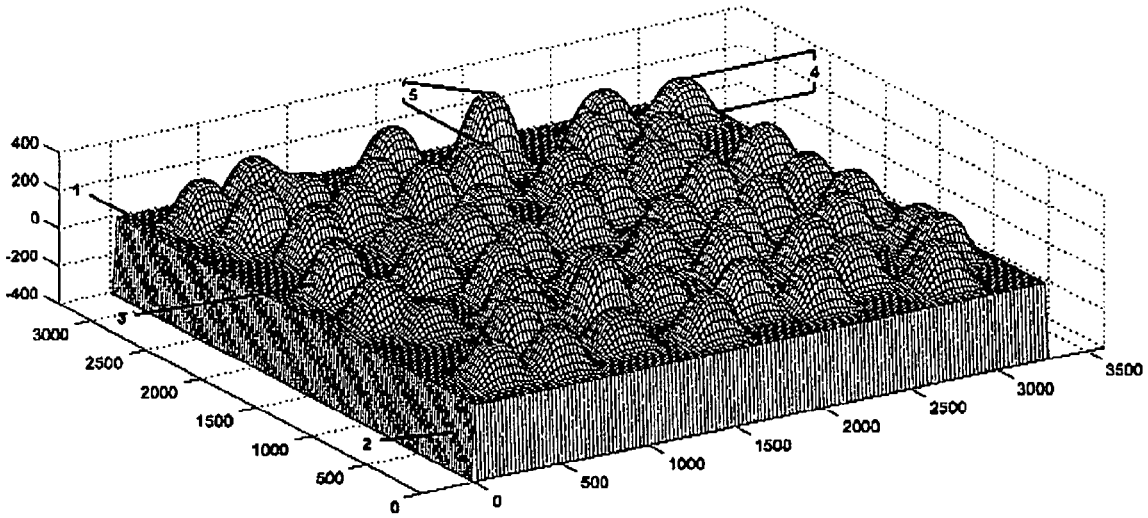
FIG. 16 shows a principle drawing of a typical grinding surface in perspective view.
Figure 17:
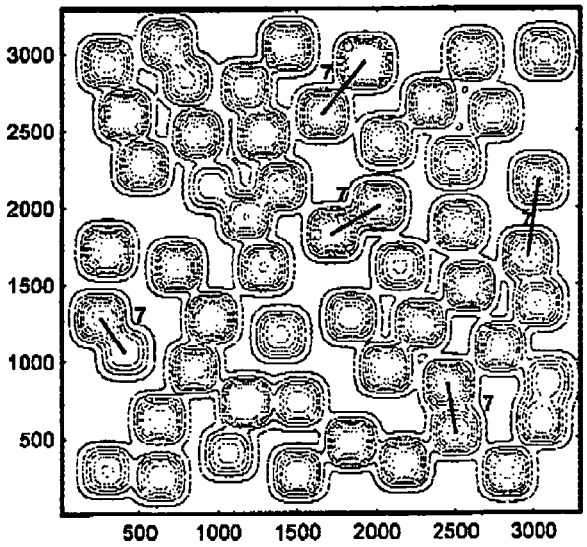
FIG. 17 shows a principle drawing of a typical grinding surface in top view.
Figure 18:
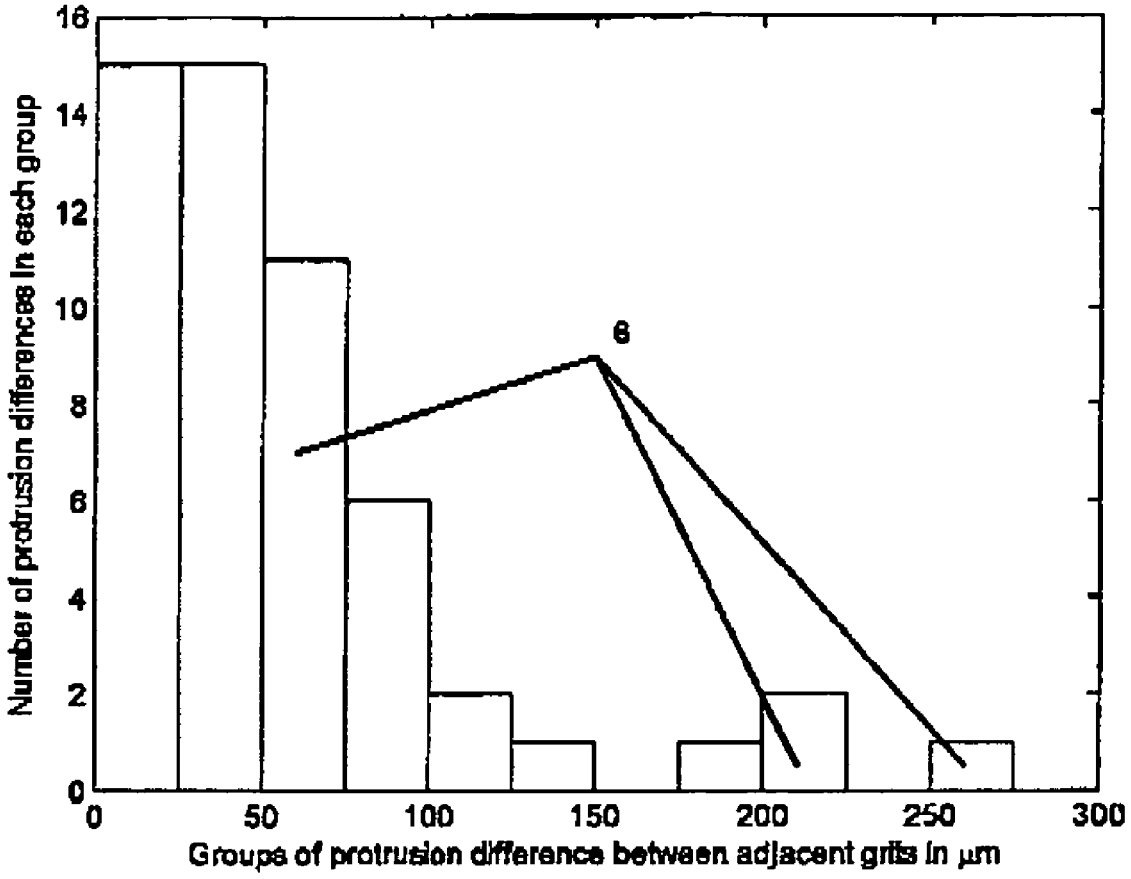
FIG. 18 shows a typical protrusion difference distribution of adjacent grits seen on the grinding surface.

The novel defibration surface of the present invention is illustrated in FIGS. 16-18, in which FIG. 16 shows a principle drawing in perspective view of a typical grinding surface in accordance with the invention. The grits 3 are attached on an essentially flat substrate 2 producing a grinding surface 1 where the grits 3 are situated in two dimensions. FIG. 17 shows the same grinding surface 1 in top view, where examples of adjacent grits 7 are marked. The protrusion of the grits is identified by the numeral 4 in FIG. 16. The protrusion, or height, differences 5 between adjacent grits 7 in the third dimension are shown as a distribution 6 in FIG. 18. Each grit protrusion on the grinding surface is compared to a protrusion of nearest other grit on the grinding surface. As the average grit diameter in the figures is 250 micrometer it can be concluded from the number of protrusions in each group of grits and the groups of protrusion, or height, difference as illustrated in FIG. 18 that 53/54 protrusions, or height, differences between adjacent grits seen on the surface, i.e. about 98.1%, are less than the average grit diameter.

The novel defibration surface can, for example, be manufactured by cutting a smooth wave form on an iron wheel by wire electroerosion and by attaching synthetic grinding grits of bulky one size form by electroplating on the wave form.

The grinding grits can also be attached by inverse galvanic coating, by brazing and/or by laser coating.

The effects of the parameters on fiber peeling harshness are summarized in Table 1.

TABLE 1

Parameters affecting fiber peeling harshness

| Increase in value of parameter | Effect on fiber peeling harshness |
|---|---|
| 1. Control of defibration | |
| Defibr. surface velocity | + |
| Wood feed rate | + |
| Wood feed force | + |
| Showering water temp. | − |
| 2. Wood structure state | |
| Density | + |
| Moisture content | − |
| Cumulative fatigue treatment | − |
| Wood temperature | − |
| 3. Defibration surface | |
| Grit size | − |
| Grit roundness | − |
| Width of grit protrusion distribution | + |

Grinding trials based on grinding means of the structure discussed herein were carried out. The results are given below.

The trial series focuses on actively four parameters that affect the fiber peeling harshness. To be able to reduce fiber peeling harshness it was decided to raise both the cumulative fatigue treatment of wood approaching the grinding zone and the grit roundness by choosing a different grit type. Additionally grits of approximately same size were applied in a 2-dimensional structure to achieve a narrow protrusion distribution of the grits. The resulting reduction in fiber peeling harshness can be utilized by raising the wood feed rate to enable high production and low specific energy consumption for the pulp produced. A desired, pre-selected freeness range was attained using data obtained by conducting pretests with different grit sizes.

Grinding surfaces with wave pattern were prepared. For the wood fatigue processing phase of grinding, a surface with a waveform was designed and prepared for more optimal grinding performance. The amplitude, frequency and surface speed parameters for the cyclic breakdown of the wood fiber matrix with the energy-efficient surface (EES) were each specified separately, FIG. 2.

In this context, a conventional ceramic stone was compared with a wave surface yielding a certain strain amplitude and further testing the grinding efficiency at two different grinding surface speeds. The amplitude chosen was 0.25 mm and surface speeds 10 and 20 m/s.

Figure 2:
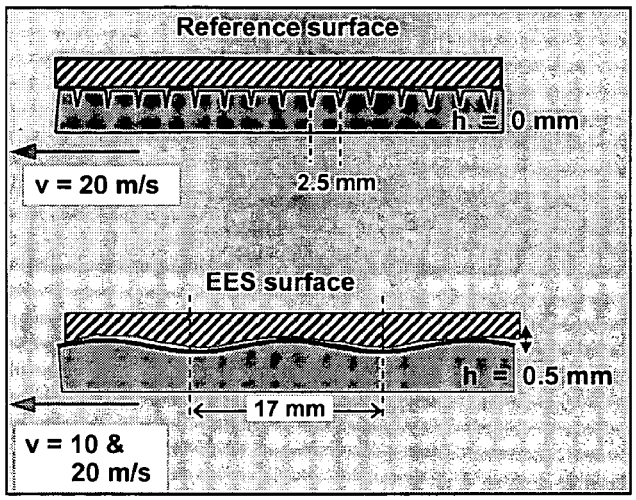
FIG. 2 shows the shapes and dimensions of the grinding surface forms.

FIG. 2 shows the shapes and dimensions of the grinding surface forms. The characteristics of the defibration surface that influence the fiber peeling phase are mainly the shape, the size and the protrusion distribution of the grits. The experiments in this paper describe defibration with optimally shaped (round, bulky) grits. The grinding surfaces had grits of roughly 0.25 mm in diameter. A conventional 38A601 pulpstone (grit size approximately 0.25 mm) with a No. 10/28° sharpening pattern is used as reference, Experimental Results Experimentally, various features relating to process control, energy consumption, fibre length, sheet strength properties and sheet structure properties were studied.

Figure 3:
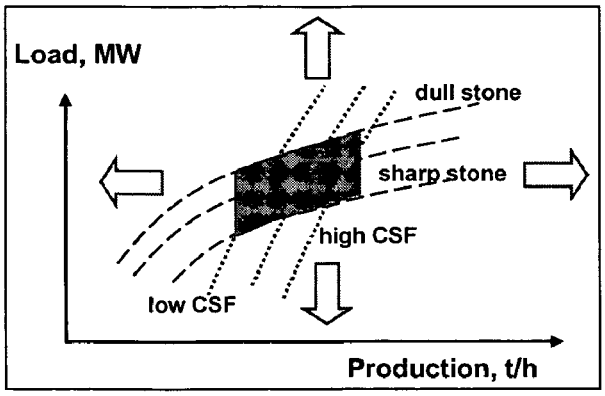
FIG. 3 indicates the operational window in grinding.

Process Control:

In practical grinding applications, e.g. production grinders, the grinding operational point is often far from its optimum due to raw material, production, motor load or other limitations. FIG. 3 shows the operational window in grinding.

Figure 4:
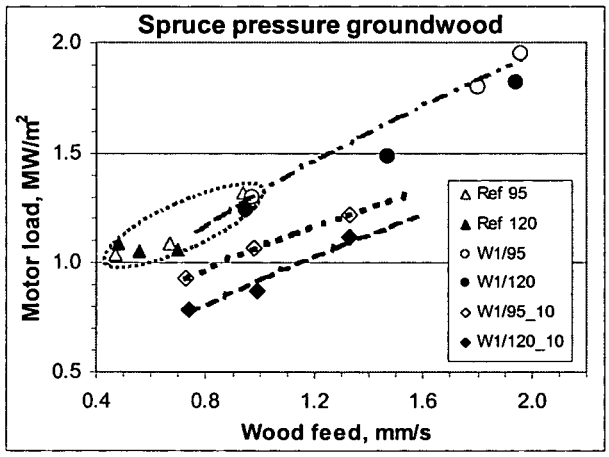
FIG. 4 depicts in graphical form the load vs. production (wood feed)
Figure 5:
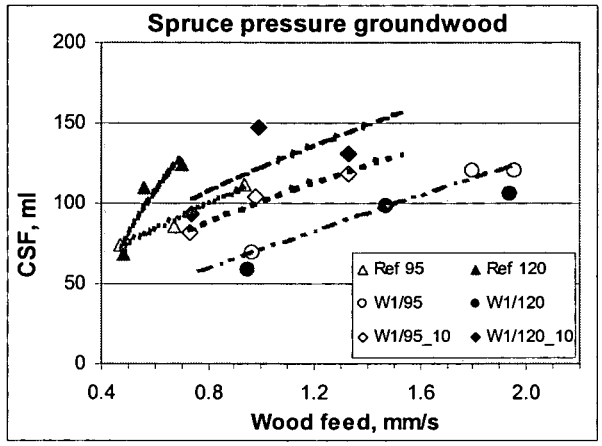
FIG. 5 shows pit pulp freeness vs. production.

Compared to the reference ceramic pulpstone surfaces, the EES enables much more sensitive controllability over a wide production range, FIG. 4. The relationship between wood feed speed (production) and wood feed load is straightforward and responds logically to changes in the process such as grinding temperature and peripheral speed of stone surface Likewise, production responds equally well with the motor load (or vice versa), showing that with the EES target pulp grades can easily be obtained, FIG. 5 (Pit pulp freeness vs. production. For legends see FIG. 4).

It is evident that the EES concept provides, within a wide range of process condition combinations such as temperature and surface speed, considerably higher production levels than grinding with the reference stone surface. When pulp is ground to a target CSF of 50 to 150 ml, production levels as much as 100% higher could be used. This was obtained with normal wood feeding forces or hydraulic pressures. A consequence of the larger operational window is that the need for sharpening procedures would be markedly reduced.

Energy Consumption

In grinding the most effective breakdown of wood fibers into high-quality pulp for board and printing papers is attained by securing the best possible interaction between wood and defibrating surface. The very efficient breakdown of the wood structure prior to peeling of the fibers from the wood matrix in the grinding zone enables mechanical pulp to be produced with only 50% of the energy typically used in groundwood pulping. At 100 ml pit pulp freeness the energy consumption is 0.7 MWh/t, FIG. 6. When the energy consumption for screened pulps produced with the EES is compared with that for the reference surface, the reduction in specific energy consumption is even larger. If we compare the energy saving at the same tensile strength, the reduction in specific energy consumption is some 30%, FIG. 7. The full energy saving potential of the stress pulse generated by a wave of the grinding surface has not yet been evaluated.

Fiber Length

Figure 8:
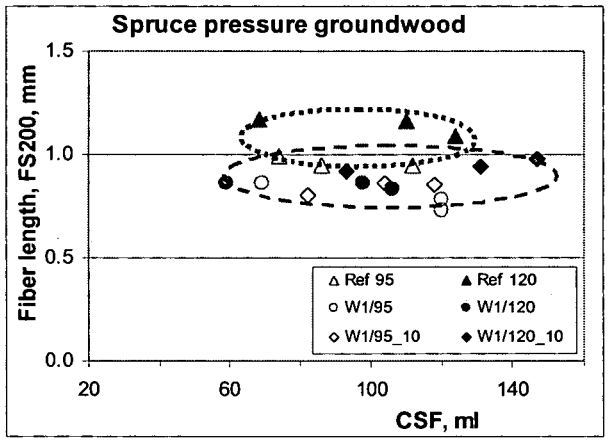
FIG. 8 indicates fiber length (length weighted) vs. freeness.

As discussed earlier in the theory part of this paper, high production rate (high wood feed rates) results in harsh peeling of the fibers from the wood matrix. We can therefore expect fiber cutting in those cases where this unfavorable condition exists. The fiber lengths were some 15-20% lower for the EES pulps than for the reference pulps, FIG. 8. However, by choosing suitable process conditions the fiber lengths could be obtained for the EES pulps that were comparable to those for the PGW95 reference pulp. The less harsh grinding conditions at the lower surface speed (10 m/s) lessened the difference in fiber length between EES pulps and reference pulps.

The percentage of long fibers (+14 BMcN fractions) was considerably lower for the EES pulps than for the reference pulps, indicating that the EES pulps could have high potential for use in high-quality printing papers.

Sheet Strength Properties

Figure 9:
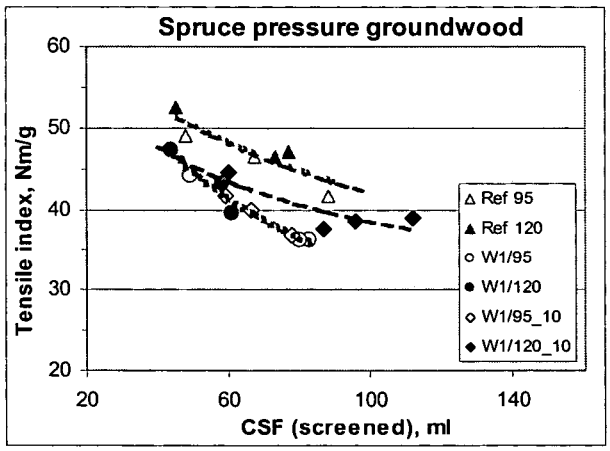
FIG. 9 depicts tensile strength vs. freeness.
Figure 10:
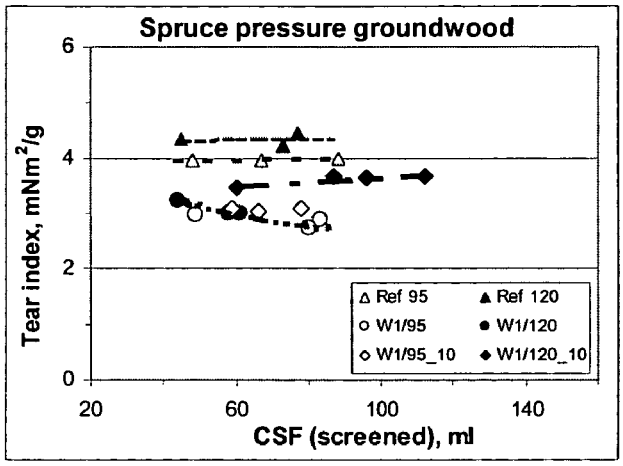
FIG. 10 shows tear strength vs. freeness.
Figure 11:
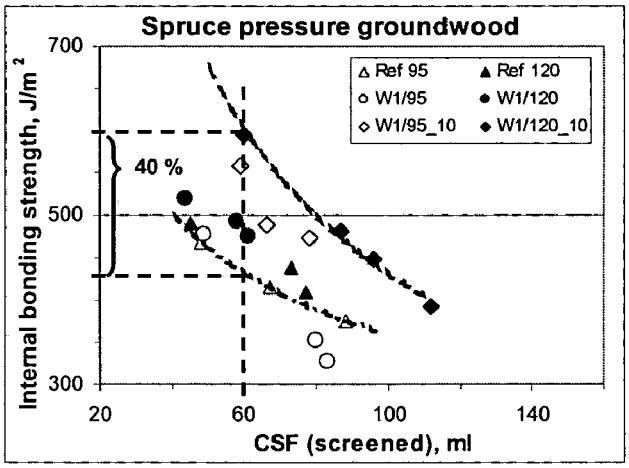
FIG. 11 indicates Z-strength vs. freeness.

The tear and tensile strengths were some 25 and 15% lower for the EES pulps, FIGS. 9 and 10. When grinding was performed under suitable process conditions the differences in these properties were only 15 and 10%, respectively However, z-strength was the same for the EES pulps, although under suitable process conditions z-strength was up to 40% higher than for the reference, FIG. 11. To fully exploit the potential of the EES concept more research is needed to explain the different nature of the EES pulp fibers.

Sleet Structure Properties

Figure 12:
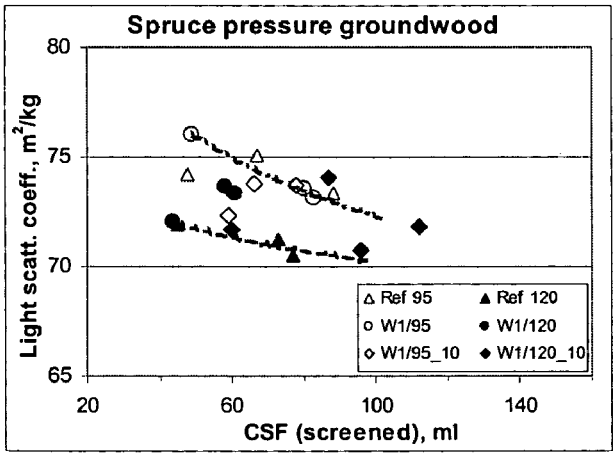
FIG. 12 depicts light scattering vs. CSF.
Figure 13:
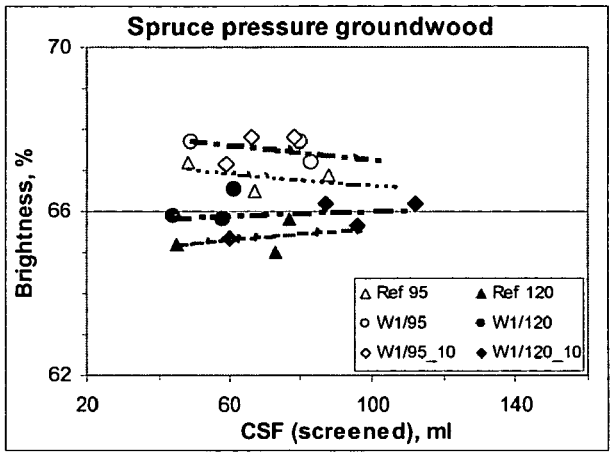
FIG. 13 shows brightness vs. CSF.

The somewhat weaker strength properties of the EES pulps bargain for good surface and web structure properties. In agreement with this the EES pulps have the same scattering capability as the reference pulps, FIG. 12. Moreover the brightness values were higher for the EES pulps, FIG. 13.

Figure 14:
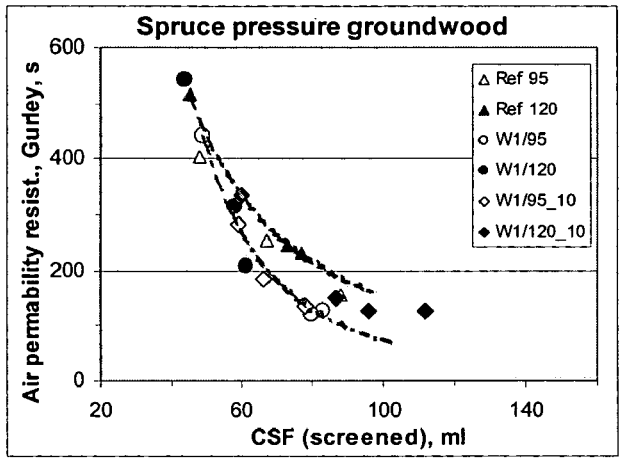
FIG. 14 shows sheet porosity vs. CSF.
Figure 15:
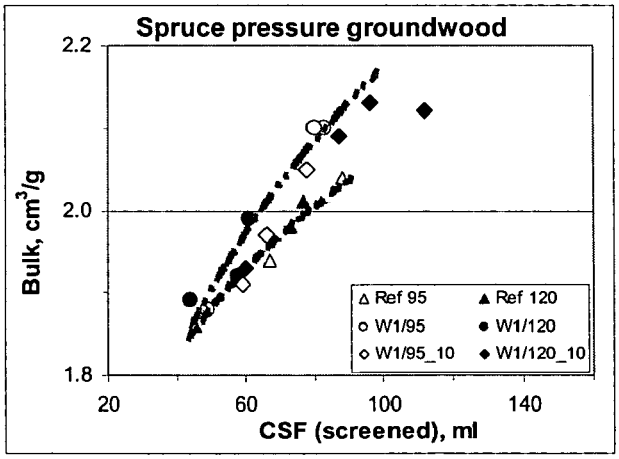
FIG. 15 shows bulk vs. CSF.

The EES pulps would most probably compete well as suitable furnish components in magazine papers. The sheet structure is more open (porous) and also exhibits the same or even better bulk properties than the reference, FIGS. 14 and 15.

As will appear from the above, the demand for more energy-efficient grinding has been addressed by examining the fundamental defibration mechanisms and by applying the knowledge in grinding trials. Experimental trials showed how fiber peeling harshness can be changed and how such changes enhance the defibration results.

The results show that the energy-efficient surface (ES) causes a more efficient breakdown of the wood structure. Semi-pilot scale grinding trials with EES indicated that the defibration process could easily be shifted between large extremes.

The grinding trials show a drop of some 30% when specific energy consumption is compared to that of a conventional pulpstone at the same tensile strength. A decrease as high as 50% is achieved when specific energy consumption is compared at the same freeness. Some loss in fiber length and strength properties is compensated by good surface and web structure properties.

It can be concluded that the well-known operating curves, earlier broadly accepted as physical relations, can be changed with this new approach. For example, the relationship between pulp quality and specific energy consumption can be replaced by a new, more favorable relationship using the EES concept

REFERENCES

1. ATACK, D., MAY, W. D., 1962. Mechanical pulping studies with a model steel wheel. Pulp and Paper Magazine of Canada 63(1962): 1, T10-T20.

2. ATACK, D., 1971. Mechanical pulping at the Institute, Part III: Mechanics of wood grinding. The activities of the Pulp and Paper Research Institute of Canada, Trend report 19(1971), 6-11.

3. KLEMM, K. H., 1955. The interpretation of groundwood production by fibre technology. Pulp Paper Mag. Can. 56:178 (1955).

4. STEENBERG, B., NORDSTRAND, A., 1962. Production and dissipation of frictional heat in the mechanical wood grinding process. Tappi, Vol. 45(1962):4, 333-336.

5. BJÖRKQVIST, T., LUCANDER, M., 2001. Grinding surface with an energy efficient profile, 2001 International Mechanical Pulping Conference, Helsinki, Finland Jun. 4-8 2001, Proceedings volume 2, s. 373-380.

6. MILES, K. B., MAY, W. D, 1990. The flow of pulp in chip refiners. J. Pulp Pap. Sci. 16 (2): J63-J72 (1990).

7. BERGSTRÖM, J., HELLSTRÖM, H., STEENBERG, B., 1957. Analysis of grinding process variables. Svensk Papperstidning 60(11):T377 (1957).

8. SANDÅS, E., 1991. Effects of pulpstone grits in wood grinding Part 3. Two-size grit mixture (various sizes). Paperi ja Puu—Paper and Timber 73(1991):7.

9. LUCANDER, M., BJÖRKQVIST, T., New approach on the fundamental defibration mechanisms in wood grinding, IMPC 2005, International Mechanical Pulping Conference, Oslo Norway, Jun. 7-9, 2005, Proceedings p. 149-155.

10. PAULAPURO, H., Operating model of a grinder. Part II. Interdependence of motor load and rate of production of a grinder. Paperi ja Puu 58 (1976)1, p. 5-18.

11. PAULAPURO, H., Operating model of a grinder. Part I. Interdependence of grinding process variables and groundwood pulp quality parameters. Paperi ja Puu 58 (1976)10, p. 659-678.

What is claimed is:

1. A method for mechanical defibration of wood, comprising grinding the wood with the surface of a grinding means for loosening and separating fibers from the wood, the grinding means comprising a substrate and grinding grits adhered thereon, wherein at least 90% of the height differences between the height of adjacent grits on the substrate is no greater than the average grit diameter.

2. The method for mechanical defibration of wood according to claim 1, wherein the grinding grits are adhered to the substrate as a 2-dimensional one layer grit construction.

3. The method for mechanical defibration of wood according to claim 1, wherein the size distribution of the grinding grits is single grade.

4. The method for mechanical defibration of wood according to claim 1, wherein the shape factor of the grinding grits is higher than 0.82.

5. The method for mechanical defibration of wood according to any one of claims 1 and 2-4 , wherein the substrate has essentially a wave form.

6. The method for mechanical defibration of wood according to any one of claims 1 and 2-4, wherein the grinding grits are adhered to the substrate by galvanic coating.

7. The method for mechanical defibration of wood according to any one of claims 1 and 2-4, wherein the grinding grits are adhered to the substrate by inverse galvanic coating.

8. The method for mechanical defibration of wood according to any one of the claims 1 and 2-4, wherein the grinding grits are adhered to the substrate by brazing.

9. The method for mechanical defibration of wood according to any one of claims 1 and 2-4, wherein the grinding grits are adhered to the substrate by laser coating.

* * * * *

UNITED STATES PATENT AND TRADEMARK OFFICE

CERTIFICATE OF CORRECTION

PATENT NO. : 7,819,149 B2
APPLICATION NO. : 11/446501
DATED : October 26, 2010
INVENTOR(S) : Mikael Lucander et al.

It is certified that error appears in the above-identified patent and that said Letters Patent is hereby corrected as shown below:

Title page, item (75), Inventors: "Tomas Björkovist" should be --Tomas Björkqvist--.

Signed and Sealed this
Twenty-ninth Day of March, 2011

David J. Kappos

David J. Kappos
*Director of the United States Patent and Trademark Office*